US005667321A

United States Patent [19]

Sago

[11] Patent Number: 5,667,321

[45] Date of Patent: Sep. 16, 1997

[54] PAPER GUIDE APPARATUS FOR USE IN AN IMAGE FORMING APPARATUS

[75] Inventor: Akira Sago, Seto, Japan

[73] Assignee: Brother Kogyo Kabushiki Kaisha, Nagoya, Japan

[21] Appl. No.: 633,078

[22] Filed: Apr. 16, 1996

[30] Foreign Application Priority Data

May 9, 1995 [JP] Japan ..... 7-110783

[51] Int. Cl.[6] ..... B41J 13/10

[52] U.S. Cl. ..... 400/642; 400/645

[58] Field of Search ..... 400/642, 645, 400/645.1, 645.4, 662, 717, 718; 226/196, 198

[56] References Cited

U.S. PATENT DOCUMENTS

| | | | |
|---|---|---|---|
| 4,913,330 | 4/1990 | Takahashi | 226/196 |
| 4,918,461 | 4/1990 | Murakami | 400/642 |
| 5,115,322 | 5/1992 | Jang | 400/642 |
| 5,388,923 | 2/1995 | Dubois et al. | 400/613.1 |
| 5,393,151 | 2/1995 | Martin et al. | 400/642 |
| 5,515,094 | 5/1996 | Tanaka et al. | 400/56 |

*Primary Examiner*—Edgar S. Burr
*Assistant Examiner*—Anthony H. Nguyen
*Attorney, Agent, or Firm*—Oliff & Berridge

[57] ABSTRACT

Printed paper is peeled off from an ink sheet at a rear sheet guide roller to be initially fed along a tangential line on a platen roller. When the leading edge of the paper reaches a projecting portion on one of two guide plates, the paper is forcibly bent or redirected toward the other guide plate beyond or through the tangential line, the paper being formed in a shape generally resembling the letter S along a clearance between the projecting portion and the other guide plate. The paper carried in this shape has an inherent stiffness and therefore does not generate vibration due to shaking when peeled off from the ink sheet at the rear sheet guide roller. Consequently, the paper does not beat the guide plates and generates no noise.

12 Claims, 5 Drawing Sheets

PAPER GUIDE APPARATUS FOR USE IN AN IMAGE FORMING APPARATUS

BACKGROUND OF THE INVENTION

1. Field of the Invention

The present invention relates to an apparatus for guiding paper delivered from an image forming assembly of an image forming apparatus such as a copier, a printer, and a facsimile device.

2. Description of Related Art

In image forming apparatuses such as mentioned above, a printing assembly is known in which, as shown in FIG. 7, a thermal head 101 is pressed against a rotating platen roller 100 on the circumferential surface thereof, a heat-transfer ink sheet (an ink ribbon) 103 is passed between paper (plain paper) 102 passing along the circumferential surface of the platen roller 100 and the thermal head 101, and a voltage is applied to a resistance heating element arranged on the thermal head 101, thereby causing the ink on the ink sheet 103 to be heat-transferred onto the surface of the paper by the heat given off from the resistance heating element.

In the above-mentioned known printing assembly, when a portion on the surface of the paper 102 to which the ink resolved from the ink sheet 103 by the heat generated by the resistance heating element is attached has moved by the rotation of the platen roller 100 from an image forming assembly 107 to the paper delivery side, the transferred ink is fused to make the ink sheet 103 adhere to the paper 102. To peel off the ink sheet 103 from the paper 102 on the delivery side, a feed path for the ink sheet 103 is bent at a sheet guide roller 108 along which the ink sheet 103 is wound around a take-up reel 106, while the printed paper 102 is guided between two opposing guide plates 104 and 105 to be delivered.

However, in the above-mentioned prior art construction, when the paper 102 to be delivered from the image forming assembly 107 is peeled off from the ink sheet 103 at the sheet guide roller 108, the paper 102 is carried in the direction of delivery (between the two guide plates 104 and 105) with the vibration caused by an uneven pattern of ink adhesion and/or an uneven adhesion of the ink to the paper 102. This vibration causes the paper 102 to beat at least one of the guide plates 104 and 105, which produces an undesirable noise.

Especially, the guide plate nearer the platen roller 100 (normally the guide plate 105 that opposes the paper from the underside) is arranged such that its surface is generally parallel to a line 109 tangential to the circumference of the platen roller 100. Consequently, the paper 102 to be delivered by the rotation of the platen roller 100 is held at its leading edge by nothing until reaching the bending delivery path formed by the two guide plates 104 and 105, so that the paper 102 shakes, inevitably beating the surface of the guide plate 105.

SUMMARY OF THE INVENTION

It is therefore an object of the present invention to provide a paper guide apparatus for use in an image forming apparatus, the paper guide apparatus preventing, by a simple construction, the above-mentioned noise from being generated from an image forming assembly.

In carrying out the invention and according to one aspect thereof, there is provided a paper guide apparatus for use in an image forming apparatus comprising two guide plates for guiding and feeding to a downstream side of feeding paper that passes through an image forming assembly composed of a printing assembly for printing an image to the paper and a roller abutted against the printing assembly. The two guide plates are arranged such that they oppose each other in a bent manner with the paper passing between them. One of the guide plates which is disposed at a position nearer the roller relative to its tangential line in the image forming assembly is formed on a surface thereof with a projecting portion for forcibly separating the paper approaching the surface toward the other guide plate beyond the tangential line.

Further, according to the invention, the paper guide apparatus has a plurality of projecting portions such as mentioned above arranged on the above-mentioned one of the guide plates across the width thereof at certain intervals and along the paper feed direction in a shape of longitudinal ribs.

In this novel construction as described above, when the leading edge of the printed paper reaches the projecting portions on one of the guide plates, the paper is forcibly bent beyond the above-mentioned tangential line toward the other guide plate to pass through a bent gap between the projecting portions and the other guide plate, and the paper is resultantly bent in a generally S shape. The paper being carried in the S shape has an inherent stiffness of its own, thereby preventing the paper from shaking. Consequently, the paper does not beat the surfaces of the guide plates, and generates no noise. The guide plates at certain intervals along the paper feed direction may include one or more longitudinal ribs.

In this novel construction above, the guide plate is provided with projecting portions in the form of longitudinal ribs rather than bending the entire width of the guide plate, and the projecting portions may be shaped differently along the width of the guide plate.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

This invention will be described in further detail by way of example with reference to the accompanying drawings.

Figure 1:
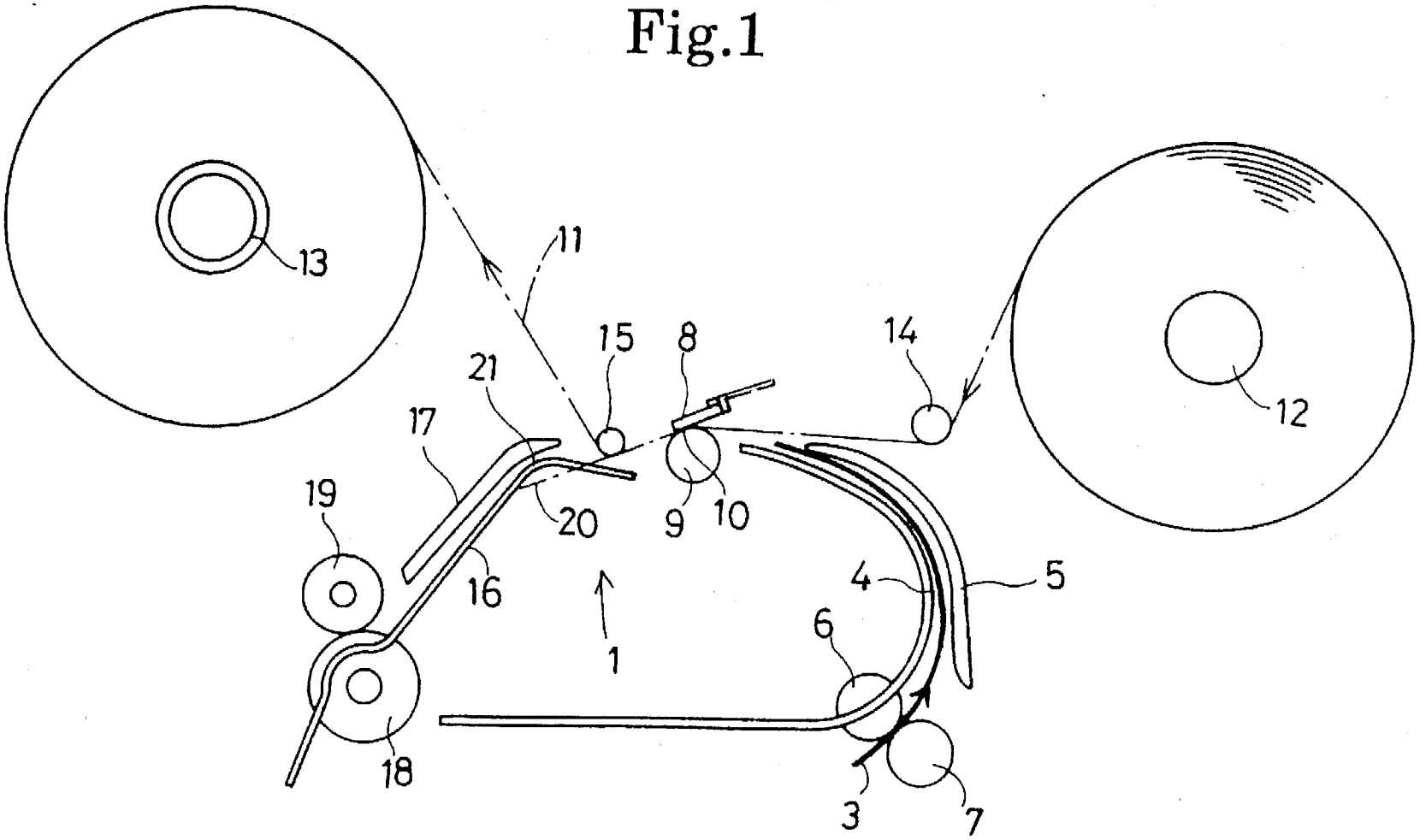
FIG. 1 is a schematic side view illustrating a paper guide apparatus practiced as the first preferred embodiment of the invention.

FIG. 1 shows a schematic side view illustrating main portions of a printing assembly and a paper guide apparatus 1 in a facsimile unit, the paper guide apparatus being practiced as the first preferred embodiment of the present invention. A sheet 3 delivered from a stack of paper set on a tray of a paper supply cassette (not shown) arranged under a main frame of the facsimile unit is fed by an intermittently swiveling paper supply roller (not shown) arranged above the paper stack. One sheet at a time is delivered between two paper supply guide plates 4 and 5 that are bent as shown in FIG. 1, for example. The paper 3 is then fed by a pair of supply rollers 6 and 7 to an image forming assembly 10 between a linear thermal head 8 and a platen roller (rotary roller) 9, the image forming assembly functioning as a printing device. The image forming assembly 10 includes a supply reel 12 around which an ink sheet 11 is wound and a take-up reel 13 for taking up the ink sheet. The ink sheet 11 is fed from the supply reel 12 along a front sheet guide roller 14 through a portion at which the thermal head 8 and the platen roller 9 are abutted against each other (namely the image forming assembly 10) to a rear sheet guide reel 15 to be wound around the take-up reel 13. The paper 3 printed in the image forming assembly 10 is fed through guide plates 16 and 17 to be delivered by a pair of delivery rollers 18 and 19 into a paper receptacle (not shown).

It should be noted that the guide plates 16 and 17 are bent as shown, for example, between the rear sheet guide roller 15 and the pair of delivery rollers 18 and 19. The guide plate 16 nearer the platen roller 9 extends toward the circumferential surface of the platen roller 9. In addition, a central portion of the guide plate 16 is formed with a projecting portion 21 that projects toward the other guide plate 17 beyond a tangential line 20 defined between the thermal head 8 and the platen roller 9 in the image forming assembly 10, downstream of the paper feed direction from the rear sheet guide roller 15.

According to the above-mentioned construction, the paper 3 and the ink sheet 11 supplied from the upstream side are tightly pressed against each other in the image forming assembly 10 in which the thermal head 8 and the platen roller 9 are pressed against each other. In the image forming assembly 10, ink at predetermined pixels on the ink sheet 11 is fused by heat generated by a resistance heating element provided on the thermal head 8 to be transferred onto the paper 3 for image formation.

Then, up to the rear sheet guide roller 15, the ink sheet 11 and the paper 3 are fed together in tight contact with each other generally in parallel to or along the tangential line 20. At the rear sheet guide roller 15, the ink sheet 11 is diverted sharply away from the tangential line 20 to be wound around the take-up reel 13.

On the other hand, the paper 3 is peeled off from the ink sheet 11 at the rear sheet guide roller 15 to be carried in the direction of the tangential line 20. When the leading edge of the paper 3 reaches the projecting portion 21 on the guide plate 16, the paper 3 is forcibly redirected or bent toward the other guide plate 17 beyond the tangential line 20. The paper 3 enters a clearance between the projecting portion 21 and the guide plate 17 in a shape generally resembling a letter S. The paper 3 in this "S" shape has an inherent stiffness in at least the longitudinal direction. Consequently, when peeled off from the ink sheet 11 at the rear sheet guide roller 15, the paper 3 does not shake. This in turn prevents the surface of the paper 3 from beating the guide plate 16. As a result, no noise is generated from contact between the guide plates and the paper 3.

Figure 2:
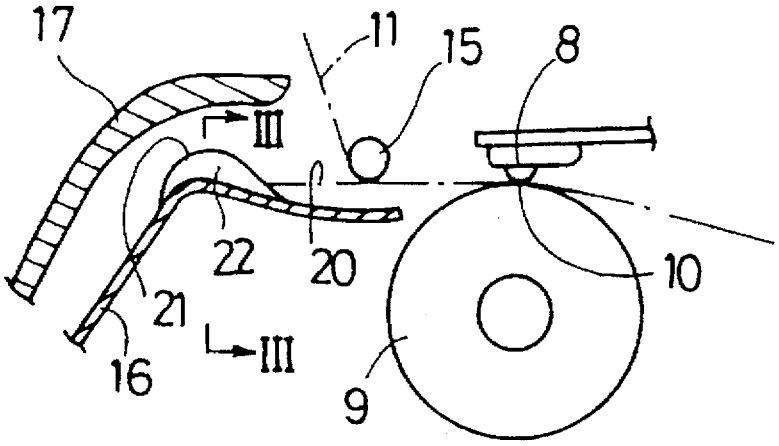
FIG. 2 is a side view illustrating the main portion of a paper guide apparatus practiced as the second preferred embodiment of the invention.
Figure 3:
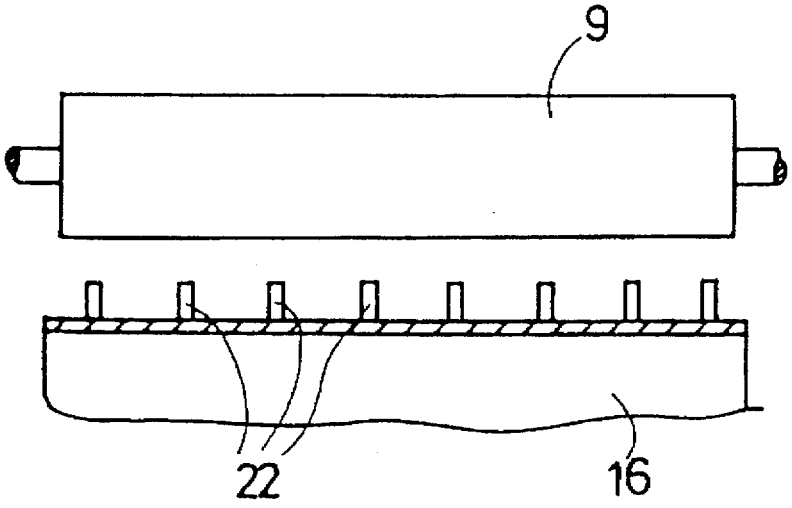
FIG. 3 is a cross sectional view of FIG. 2 along line III—III.

The second preferred embodiment is shown in FIGS. 2 and 3. The projecting portion 21 provided midway on the guide plate 16 is formed by a plurality of longitudinal ribs 22 arranged along the paper feed direction. It should be noted that the plurality of longitudinal ribs 22 are arranged on the guide plate 16 in a projected manner at appropriate intervals generally across the width of the paper 3. Because the projecting portion 21 is formed by the plurality of longitudinal ribs 22, a plurality of projecting portions 21 may be advantageously provided along the width of the flat guide plate 16, unlike providing the single projecting portion of FIG. 1 fully along the entire width of the guide plate 16.

It will be apparent to those skilled in the art that the printing assembly used in the present invention may be of electrophotographic type in which toner is attached to an electrostatic latent image on a photosensitive drum and a resultant toner image is transferred to paper to be fused by heating and pressing, instead of the above-mentioned printing assembly using a thermal head and an ink sheet (ink ribbon).

While the preferred embodiments of the present invention have been described using specific terms, such description is for illustrative purposes only, and it is to be understood that changes and variations may be made without departing from the spirit or scope of the appended claims.

Figure 4:
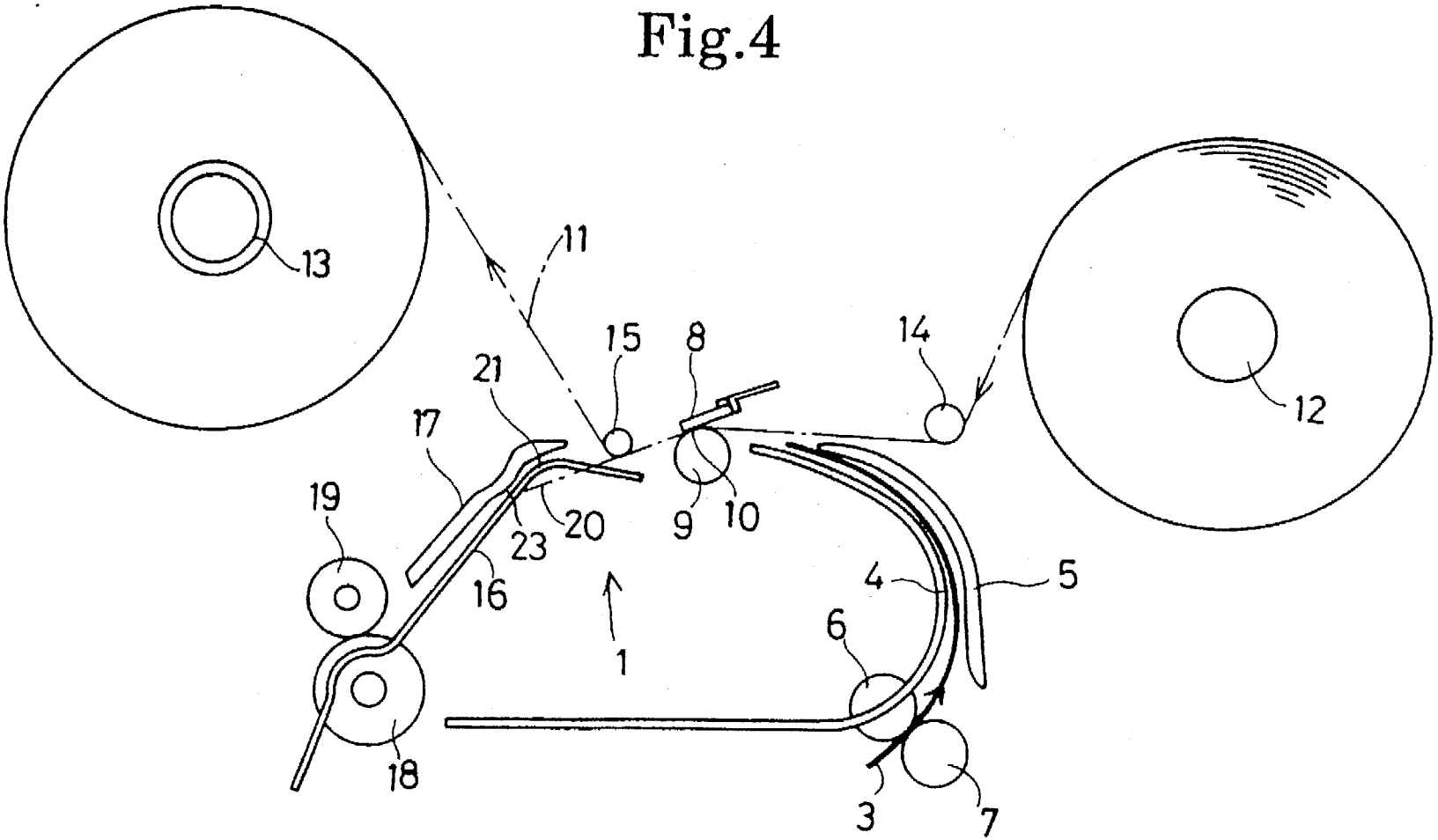
FIG. 4 is a schematic side view illustrating the first modification to the paper guide apparatus according to the invention.

For example, referring to FIG. 4, a projecting portion 23 may be provided on the guide plate 17 of FIG. 1 at a position nearer the pair of delivery rollers 18 and 19 rather than the position at which the projecting portion 21 is located on the guide plate 16 opposing the guide plate 17. In this construction, the paper 3 is peeled off from the ink sheet 11 at the rear sheet guide roller 15 and carried toward the pair of delivery rollers 18 and 19. When the leading edge of the paper 3 reaches the projection portion 23 provided on the guide plate 17, the paper 3 is forcibly bent toward the guide plate 16 to be led into a clearance between the projecting portion 23 and the guide plate 16 to be further bent into a shape generally resembling the letter S. The paper 3 bent in such a shape has an inherent stiffness of its own. Consequently, the paper 3 does not beat by the surface thereof the guide plate 17, generating no noise.

Figure 5:
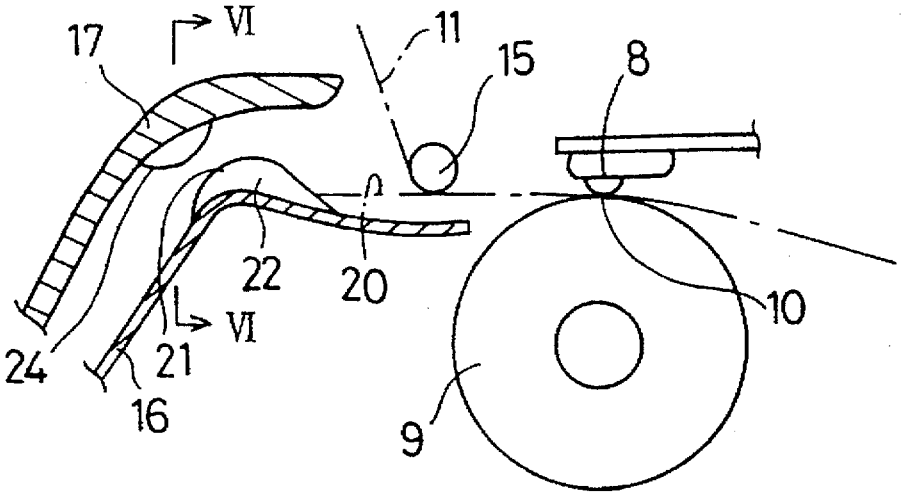
FIG. 5 is a schematic side view illustrating the second modification to the paper guide apparatus according to the invention.
Figure 6:
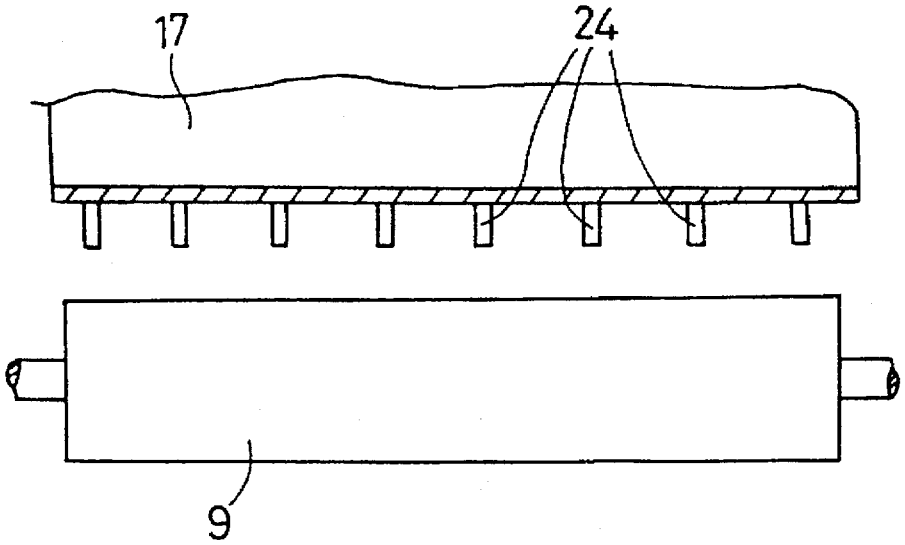
FIG. 6 is a cross sectional view of FIG. 5 along line VI—VI.
Figure 7:
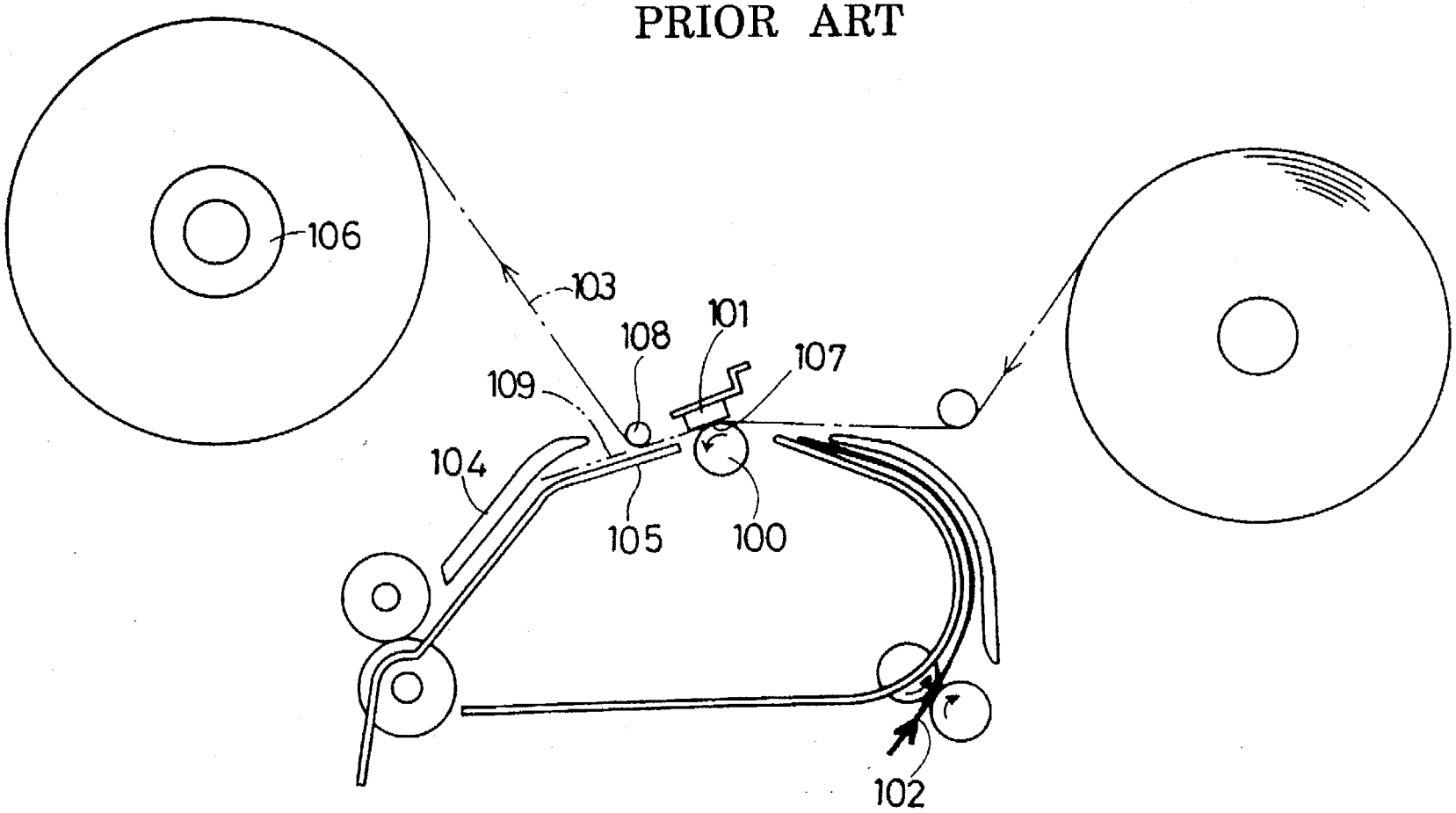
Fig.7 PRIOR ART
FIG. 7 is a schematic side view of a prior art paper guide apparatus.

Further, referring to FIGS. 5 and 6, the projecting portion 23 provided midway on the guide plate 17 may be formed by a plurality of longitudinal ribs 24 arranged along the feed direction of the paper. The plurality of longitudinal ribs 24 are provided on the guide plate 17 along substantially the entire width of the paper 3 at appropriate intervals. According to this construction, the projecting portion 23 (FIG. 4) is formed by the plurality of longitudinal ribs 24, and a plurality of projecting portions 23 may be advantageously provided along the width of the flat guide plate 17, unlike providing the single projecting portion along the entire width of the guide plate 17 (FIG. 4).

What is claimed is:

1. A paper guide apparatus comprising:

printing means for printing paper with an ink sheet, said paper including a leading edge;

a roller abutting against said printing means;

a pair of opposed guide plates for guiding said paper downstream from said printing means and said roller;

a first surface provided on one of the pair of opposed guide plates and a second surface provided on the other one of said pair of opposed guide plates; and a device for imparting stiffness to the paper including a projecting portion provided on the first surface to forcibly redirect said leading edge of said paper approaching said first surface through a tangential line that is tangential at a point of contact of the printing means with said roller to the second surface such that the leading edge contacts the second surface provided on the other one of said pair of opposed guide plates.

2. The paper guide apparatus as claimed in claim 1, wherein said pair of guide plates are arranged in a bent form on upper and lower sides of said paper, a surface of one of the pair of guide plates that is arranged near said roller relative to said tangential line being formed with a projecting portion for making said paper approaching said surface forcibly depart toward a surface of the other guide plate through the tangential line of said roller.

3. The paper guide apparatus as claimed in claim 2, wherein said projecting portion comprises a plurality of projections spaced along the width of said paper, each of the plurality of projecting portions comprising a longitudinal rib formed along the paper feed direction.

4. The paper guide apparatus as claimed in claim 2, further comprising a second projecting portion provided on a surface of the other of said pair of guide plates for making the paper approaching said second surface forcibly depart back toward the first surface of said one of said pair of guide plates.

5. The paper guide apparatus as claimed in claim 4, wherein said second projecting portion comprises a plurality of projections provided along the width of said paper at appropriate intervals, each of the plurality of projecting portions comprising a longitudinal rib formed along the paper feed direction.

6. A paper guide apparatus, comprising:

printing means for printing paper with an ink sheet;

a roller abutting against said printing means;

separating means for separating the printed paper from said ink sheet;

a pair of opposed guide plates for guiding said paper downstream from said printing means and said roller; and guiding means provided on a surface of said pair of guide plates, said guiding means defining an angle of greater than zero as measured between a line along the feed direction of a leading edge of said paper approaching said surface and a straight line connecting the roller and said separating means, wherein said guiding means comprises a pair of downstream guide plates arranged on upper and lower sides of said paper, a surface of one of the pair of guide plates that is arranged nearest said roller relative to a tangential line that is tangential at a point of contact of the printing means with said roller being formed with a device for imparting stiffness to the paper including a projecting portion for forcibly redirecting said paper approaching said surface to contact a surface of the other guide plate through the tangential line of said roller.

7. The paper guide apparatus as claimed in claim 6, further comprising take-up means for taking up said ink sheet after printing, said guiding means shifting said paper toward the ink sheet take-up means.

8. The paper guide apparatus as claimed in claim 6, wherein said guiding means is arranged along the width of said paper at appropriate intervals, said guiding means comprising a plurality of longitudinal ribs spaced along the paper feed direction.

9. The paper guide apparatus as claimed in claim 6, wherein said projecting portion includes a plurality of projections spaced along the width of said paper at appropriate intervals, each of the plurality of projecting portions comprising a longitudinal rib formed along the paper feed direction.

10. The paper guide apparatus as claimed in claim 6, wherein said guiding means comprises a second projecting portion provided on said surface of the other of said pair of guide plates for making the paper approaching said surface forcibly depart back toward the surface of said one of said pair of guide plates.

11. The paper guide apparatus as claimed in claim 10, wherein said second projecting portion comprises a plurality of projections provided along the width of said paper at appropriate intervals, each of the plurality of projecting portions comprising a longitudinal rib formed along the paper feed direction.

12. A paper guide apparatus comprising:

a printer for printing characters on a recording medium;

a roller abutting against said printer at a tangential point of contact that defines a tangential line of the roller;

a pair of opposed guide plates for initially guiding said recording medium along a first path substantially parallel to the tangential line of said roller; and a device for imparting stiffness to the recording medium including a projecting portion provided on a first surface of at least one of said pair of guide plates to forcibly redirect said recording medium approaching said first surface along a second path that is not parallel to the first path to contact a second surface provided on the other one of said pair of opposed guide plates.

* * * * *